US009283665B2

(12) United States Patent
Chern

(10) Patent No.: US 9,283,665 B2
(45) Date of Patent: Mar. 15, 2016

(54) HAMMER STRUCTURE

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 276 days.

(21) Appl. No.: 14/101,884

(22) Filed: Dec. 10, 2013

(65) Prior Publication Data

US 2015/0158164 A1 Jun. 11, 2015

(51) Int. Cl.

| | |
|---|---|
| ***B25D 1/12*** | (2006.01) |
| ***B25D 1/04*** | (2006.01) |
| ***B25G 1/01*** | (2006.01) |
| ***B25G 1/02*** | (2006.01) |
| ***B25G 3/26*** | (2006.01) |

(52) U.S. Cl.

CPC .. *B25D 1/04* (2013.01); *B25G 1/01* (2013.01); *B25G 1/02* (2013.01); *B25G 3/26* (2013.01)

(58) Field of Classification Search

CPC ..... B25D 1/04; B25D 1/12; B25G 1/01; B25G 1/02; B25G 3/26; B25G 3/30; B25G 3/32

USPC ..... 81/20, 22

See application file for complete search history.

(56) References Cited

U.S. PATENT DOCUMENTS

| | | | | | |
|---|---|---|---|---|---|
| 419,953 | A * | 1/1890 | Huller | B25D 1/12 | 125/40 |
| 1,515,708 | A * | 11/1924 | Stolle | B25G 3/28 | 254/26 R |
| 1,518,259 | A * | 12/1924 | Filiatreault | B25G 3/32 | 16/422 |
| 1,628,897 | A * | 5/1927 | Mills | B25G 3/32 | 16/422 |
| 2,467,284 | A * | 4/1949 | Williams | B25G 1/10 | 16/110.1 |
| 4,096,895 | A * | 6/1978 | Fernitz | B25G 3/10 | 81/20 |
| 4,633,741 | A * | 1/1987 | Yang | B25G 1/01 | 81/19 |
| 4,683,784 | A * | 8/1987 | Lamont | B25G 1/01 | 16/431 |
| 5,280,739 | A * | 1/1994 | Liou | B25G 3/02 | 81/22 |
| 5,372,053 | A * | 12/1994 | Lee | B25G 3/30 | 81/20 |
| 7,096,761 | B2 * | 8/2006 | Schoor | B25D 1/045 | 81/20 |
| 8,359,949 | B2 * | 1/2013 | Onello et al. | B25D 1/14 | 81/20 |

* cited by examiner

*Primary Examiner* — David B Thomas

(74) *Attorney, Agent, or Firm* — Pro-Techtor International Services; Jan Oglesby

(57) ABSTRACT

A hammer structure includes a hammer head and a handle is connected to the head. The handle has multiple parallel resilient sticks received therein. Each of the resilient sticks has a first threaded section and a second threaded sections formed on two ends thereof. A first locking member and a second locking member are respectively connected to the first and second threaded sections. The first threaded sections of the resilient sticks extend through multiple through holes in the hammer head and are connected with multiple third locking members. The second threaded sections of the resilient sticks are fixed to the handle. The handle includes multiple coats. The resilient sticks absorb vibrations when using the hammer.

8 Claims, 9 Drawing Sheets

HAMMER STRUCTURE

BACKGROUND OF THE INVENTION

1. Fields of the Invention

The present invention relates to a hammer structure, and more particularly, to a hammer structure that absorbs vibration.

2. Descriptions of Related Art

The conventional hammer comprises a metal-made head which is connected with a wood stick as a handle. The user holds the handle to hammer nails by the head. However, the use of the metal-made head generates a significant reaction force which is transferred to the handle and the user's hand. The reaction force causes vibrations which makes the user uncomfortable and sore. The user's hand may be injured by the severe vibrations.

The present invention intends to provide a hammer structure which improves the shortcomings mentioned above.

SUMMARY OF THE INVENTION

The present invention relates to a hammer structure and comprises multiple parallel resilient sticks located in a handle and the resilient sticks are parallel to each other. Each resilient stick has a first threaded section and a second threaded sections formed on two ends thereof. A first locking member and a second locking member are respectively connected to the first and second threaded sections. A hammer head has through holes and the first threaded sections of the resilient, sticks extend through the through holes of the hammer head. Multiple third locking members are connected to the first threaded sections of the resilient sticks. The second threaded sections of the resilient sticks are fixed to the handle. The handle comprises a first coat and a second coat which is mounted to the first coat. The first coat is mounted to the resilient sticks.

Preferably, the resilient sticks are made by metal.

Preferably, the first and second coats are integrally formed with each other by way of injection molding.

Preferably, the first coat is made by Polypropylene or Nylon.

Preferably, the second coat is made by soft rubber.

Preferably, the soft rubber of the second coat is thermoplastic rubber.

Preferably, a third coat is mounted to the second coat.

Preferably, the third coat is made by soft resilient rubber.

The primary object of the present invention is to provide a hammer structure which absorbs vibration when in use.

Another object of the present invention is to provide a hammer structure which ensures that the user's hand does not feel uncomfortable and sore.

The present invention will become more obvious from the following description when taken it connection with the accompanying drawings which show, for purposes of illustration only, a preferred embodiment in accordance with the present invention.

DETAILED DESCRIPTION OF THE PREFERRED EMBODIMENT

Figure 1:
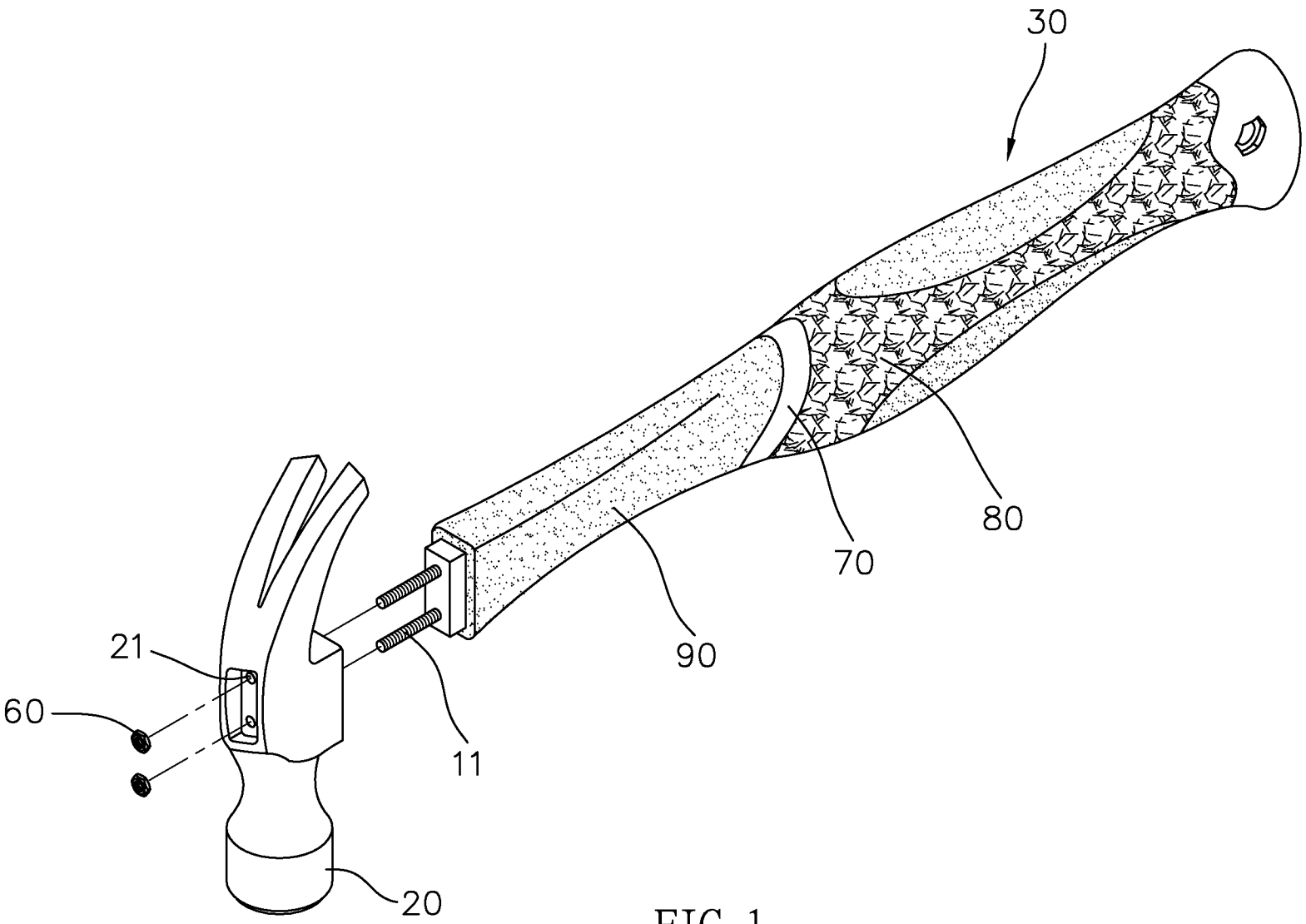
FIG. 1 is an exploded view of the hammer structure of the present invention.
Figure 2:
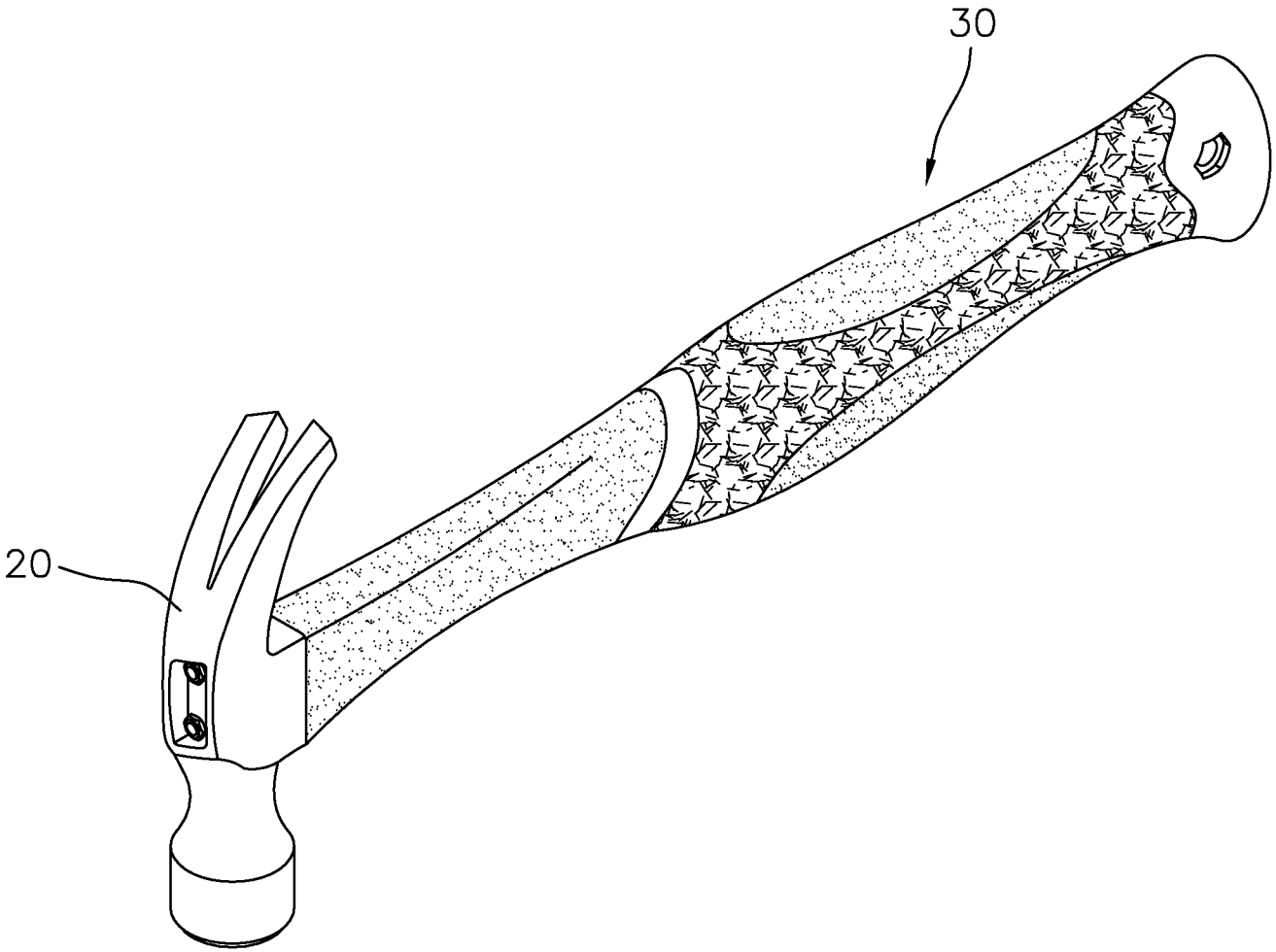
FIG. 2 is a perspective view to show the hammer structure of the present invention.
Figure 3:
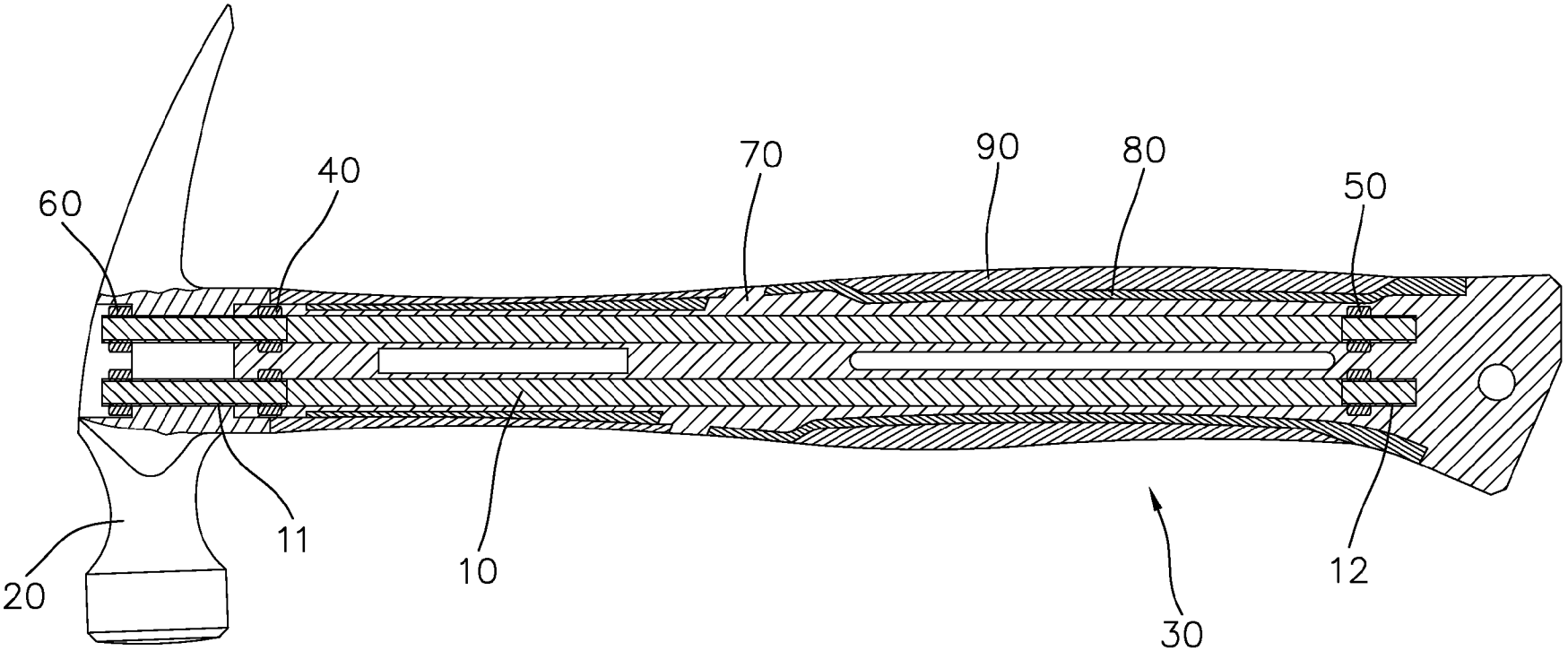
FIG. 3 is a cross sectional view of the hammer structure of the present invention.
Figure 4:
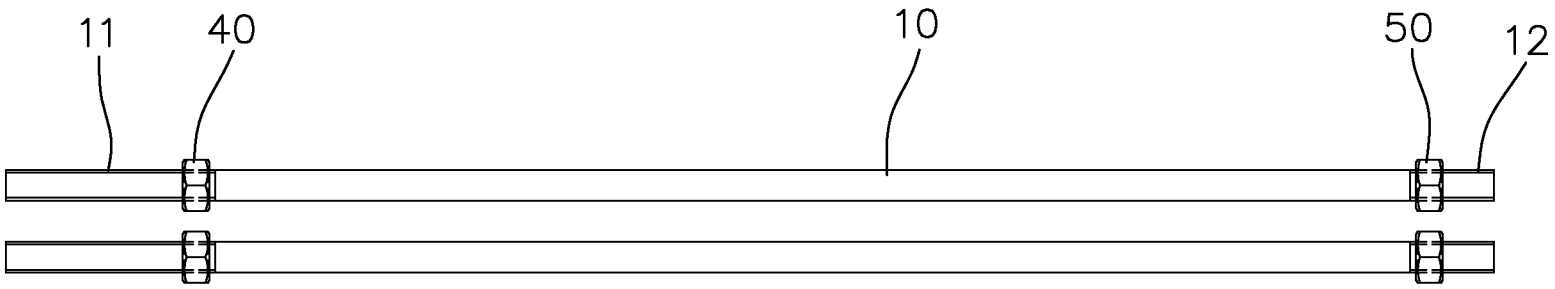
FIGS. 4 to 7 show the steps for manufacturing the hammer structure of the present invention.
Figure 5:
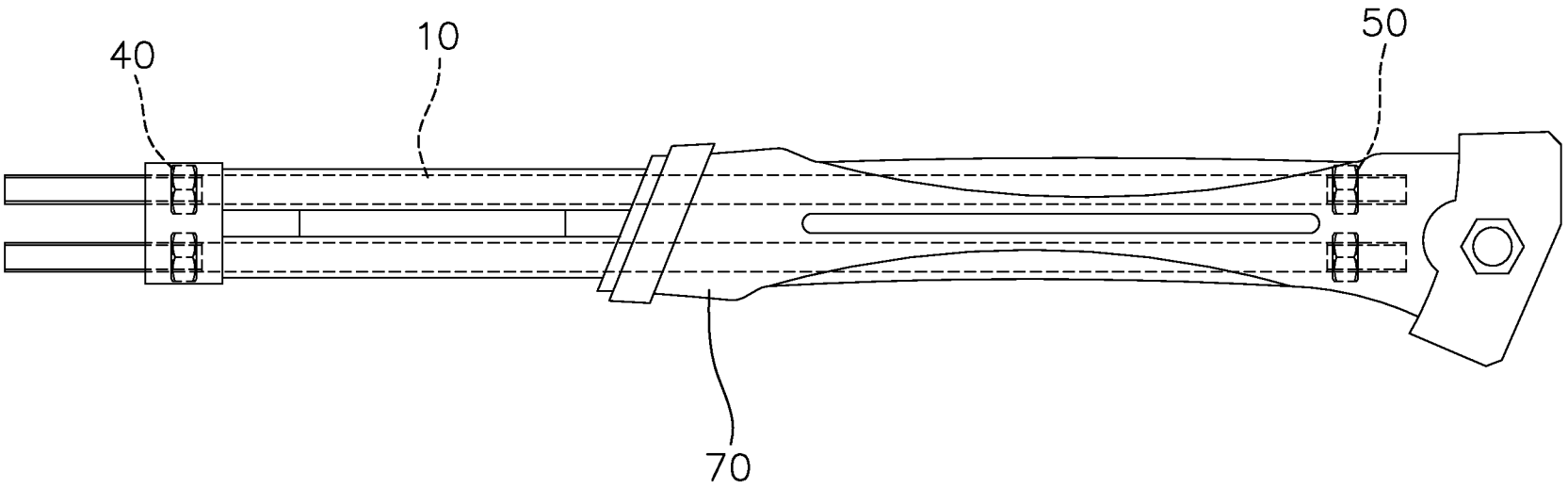
Figure 6:
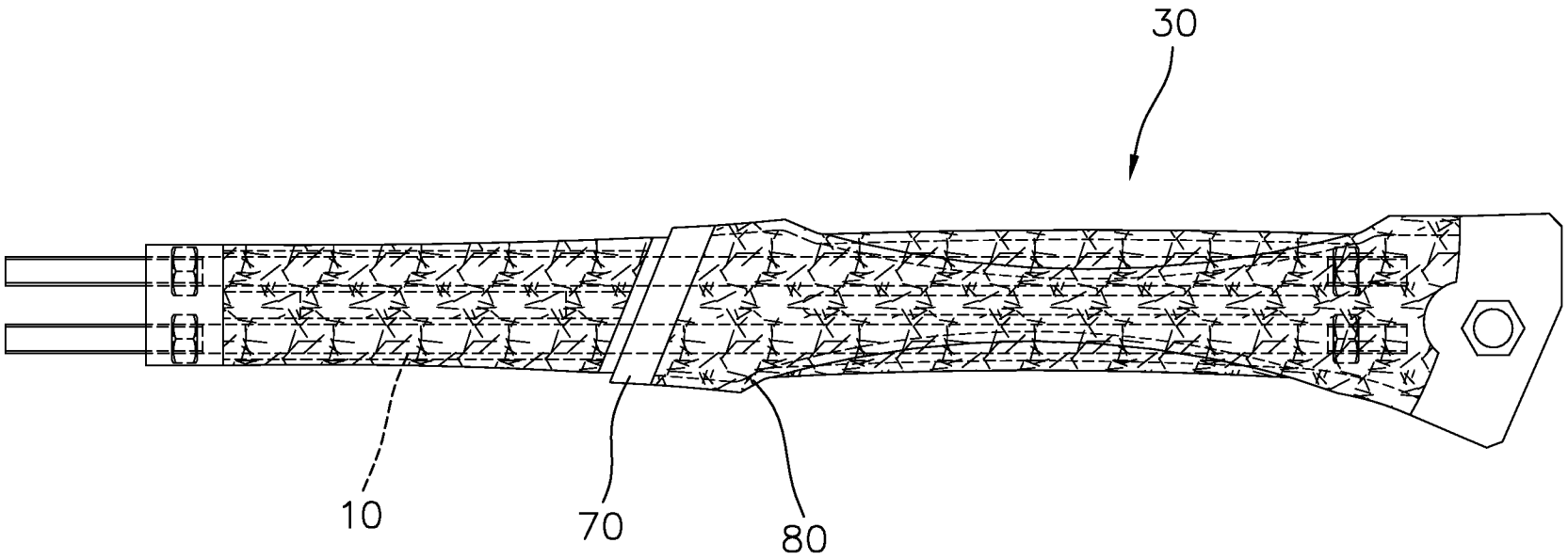

Referring to FIGS. 1 to 9, the hammer structure of the present invention comprises multiple parallel resilient sticks 10, a head 20 with through holes 21, and a handle 30. The resilient sticks 10 are located in the handle 30 and parallel to each other. Each resilient stick 10 is made by metal and has a first threaded section 11 and a second threaded sections 12 formed on two ends thereof. A first locking member 40 and a second locking member 50 are respectively connected to the first and second threaded sections 11, 12 as shown in FIG. 4.

The head 20 has through holes 21 defined therethrough and the first threaded sections 11 of the resilient sticks 10 extend through the through holes 21 of the hammer head 20. Multiple third locking members 60 are connected to the first threaded sections 11 of the resilient sticks 10 so as to connect the head 20 to the handle 10. The second threaded sections 12 of the resilient sticks 10 being fixed to the handle 30.

Figure 7:
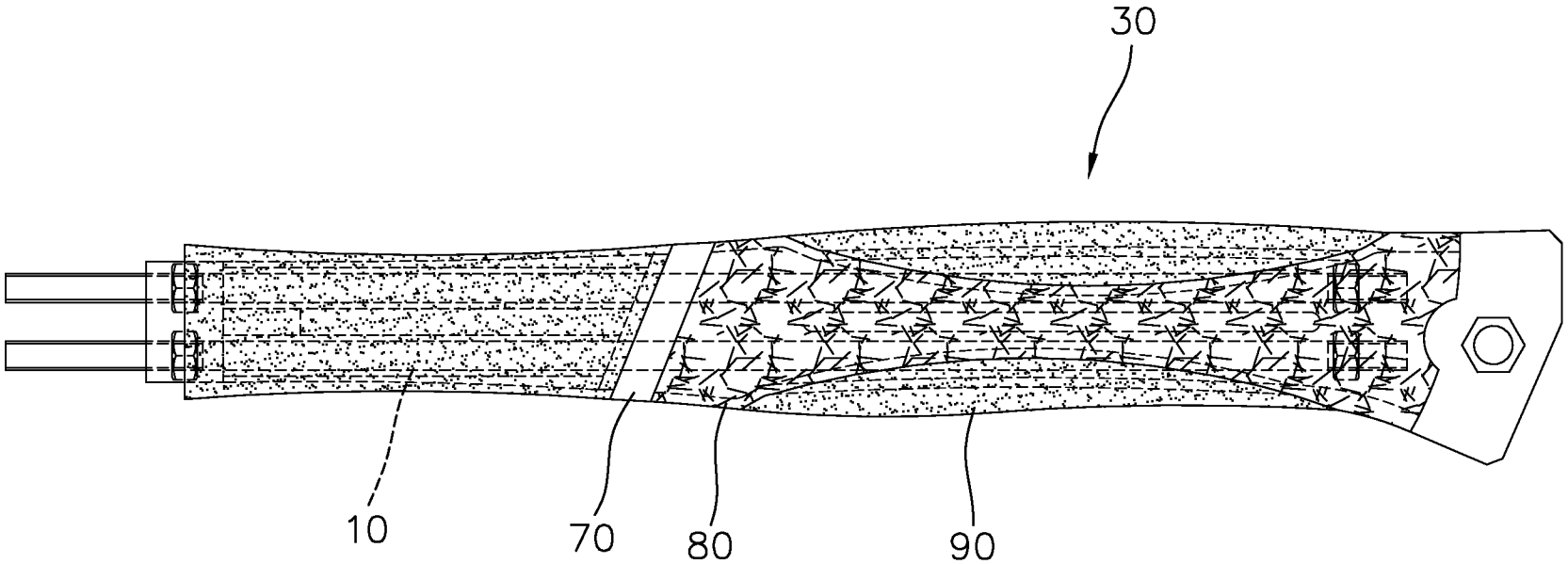
Figure 8:
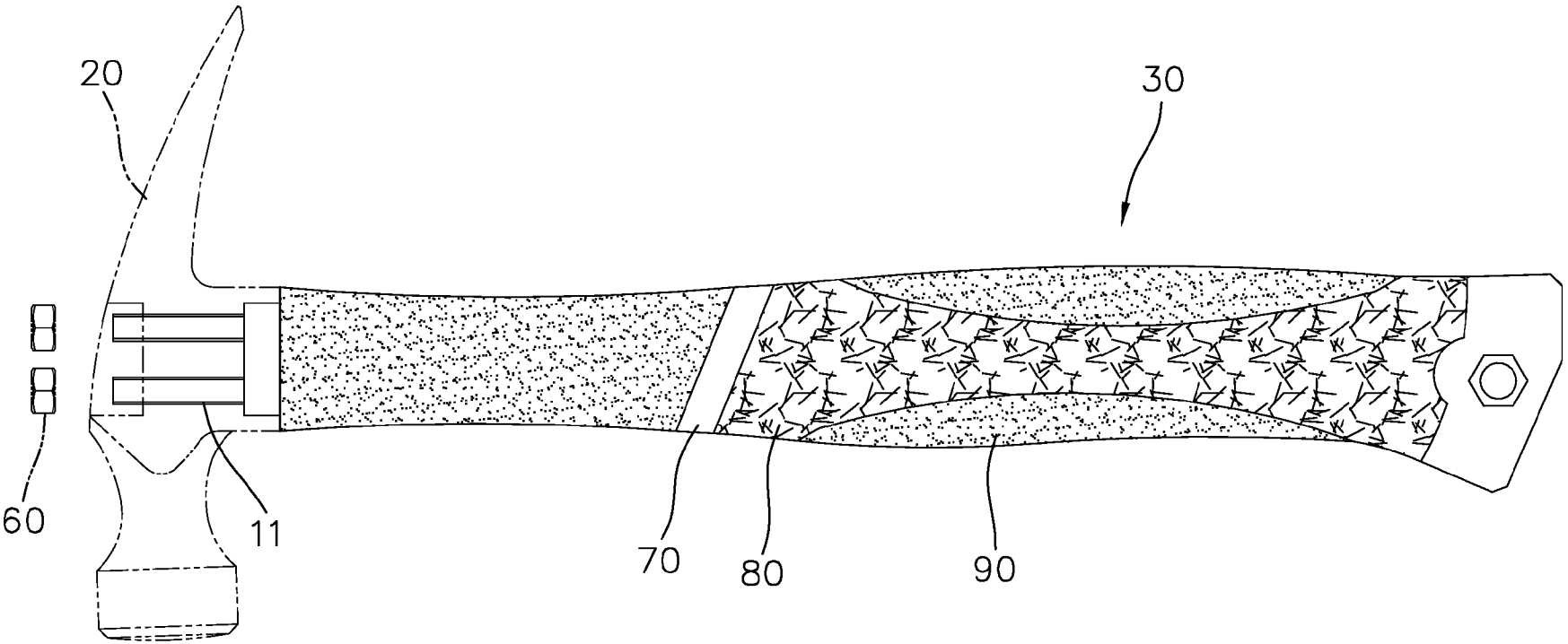
FIGS. 8 and 9 show the steps for assembling the head to the resilient sticks on the handle of the hammer structure of the present invention.
Figure 9:
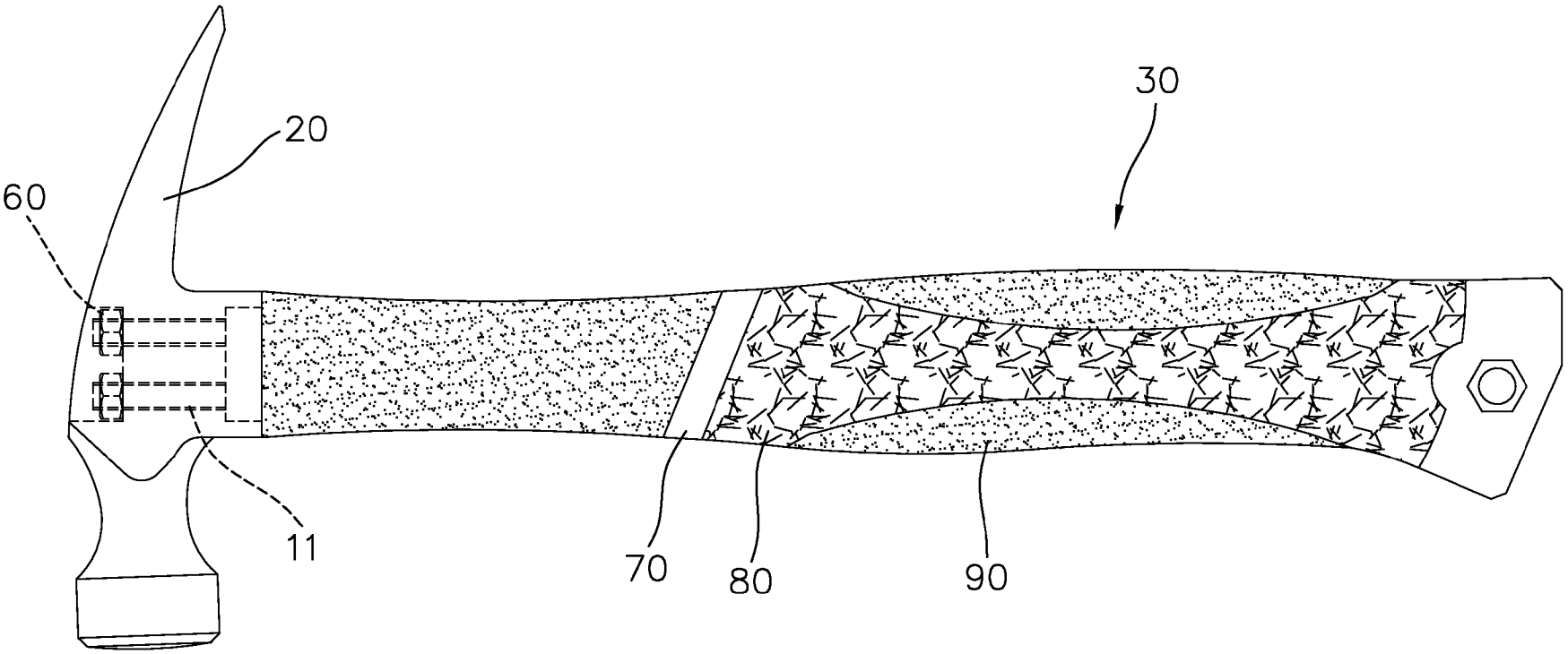

The handle 30 comprises a first coat 70 and a second coat 80 which is mounted to the first coat 70, the first coat 70 mounted to the resilient sticks 10. The first and second coats 70, 80 are integrally formed with each other by way of injection molding. The first coat 70 is made by Polypropylene or Nylon, and the second coat 80 is made by soft rubber which can be thermo-plastic rubber. A third coat 90 is mounted to the second coat 80 when needed as shown in FIG. 7. The third coat 90 is made by soft resilient rubber.

The handle 30 has resilient sticks 10 located therein which are mounted by the first coat 70, and the second coat 80 is mounted to the first coat 70 so as to provide better buffering feature when in use.

When using the hammer to hammer objects, because of the resilient sticks 10, the head 20 may be bent an angle relative to the handle 30 so that the shakes and vibrations can be reduced and the user's hand is protected from being injured by severe vibration and impacts. The head 20 is fixed by the third locking members 60 so that the head 20 is secured and does not separate from the handle 3.

The hammer structure of the present invention has proper flexibility so that the user can use the hammer easily and comfortably.

While we have shown and described the embodiment in accordance with the present invention, it should be clear to those skilled in the art that further embodiments may be made without departing from the scope of the present invention.

What is claimed is:

1. A hammer structure comprising:

multiple parallel resilient sticks located in a handle, the resilient sticks being parallel to each other, each resilient slick having a first threaded section and a second threaded sections formed on two ends thereof, a first locking member and a second locking member respectively connected to the first and second threaded sections;

a hammer head having through holes and the first threaded sections of the resilient sticks extending through the through holes of the hammer head, multiple third locking members connected to the first threaded sections of the resilient sticks, the second threaded sections of the resilient sticks being fixed to the handle, and the handle comprising a first coat and a second coat which is mounted to the first coat, the first coat mounted to the resilient sticks.

2. The hammer structure as claimed in claim 1, wherein the resilient sticks are made by metal.

3. The hammer structure as claimed in claim 2, wherein the first and second coats are integrally formed with each other by way of injection molding.

4. The hammer structure as claimed in claim 1, wherein the first coat is made by Polypropylene or Nylon.

5. The hammer structure as claimed in claim 1, wherein the second coat is made by soft rubber.

6. The hammer structure as claimed in claim 5, wherein the soft rubber of the second coal is thermo-plastic rubber.

7. The hammer as claimed in claim 1, wherein a third coat is mounted to the second coat.

8. The hammer structure as claimed in claim 7, wherein the third coat is made by soft resilient rubber.

* * * * *